United States Patent [19]

Swatik et al.

[11] 3,972,280

[45] Aug. 3, 1976

[54] APPARATUS FOR TIME SHARING OF HORIZONTAL AND VERTICAL ADVANCE

[75] Inventors: Donald S. Swatik, New Baltimore; Vahe H. Malakian, Sterling Heights; Joseph E. Mishark, Rochester, all of Mich.

[73] Assignee: Computer Peripherals, Inc., Edina, Minn.

[22] Filed: Dec. 9, 1974

[21] Appl. No.: 530,636

[52] U.S. Cl. ..... 101/93.16; 74/674; 197/127 R

[51] Int. Cl.[2] ..... B41J 9/04

[58] Field of Search ..... 101/235, 245, 93.15, 101/93.16, 93.09, 287, 288, 318; 74/674; 197/127 R, 49

[56] References Cited

UNITED STATES PATENTS

| | | | |
|---|---|---|---|
| 3,331,315 | 7/1967 | Henry | 101/288 X |
| 3,331,316 | 7/1967 | Bretti | 101/93.16 |
| 3,415,182 | 12/1968 | White | 101/288 X |
| 3,489,084 | 1/1970 | Strickland et al. | 101/316 X |
| 3,599,772 | 8/1971 | Comstock | 101/93.16 X |
| 3,667,383 | 6/1972 | Mack et al. | 101/93.16 |

*Primary Examiner*—Edgar S. Burr
*Assistant Examiner*—Edward M. Coven
*Attorney, Agent, or Firm*—J. T. Cavender; Wilbert Hawk, Jr.; George J. Muckenthaler

[57] ABSTRACT

A prime mover is connected to a drive train in a printer to provide incremental or intermittent motion to the paper and to the hammer bank in a time sharing manner wherein the output of a closed loop control mode having a switching amplifier and a feedback circuit utilizing pulse width modulated signals operate the system under static conditions. The drive train includes the use of a planetary gear head and electromagnetic friction brakes for transducing the output from the prime mover to the two loads. Alternate transducing means include the use of two clutches, or a planetary gear head and band brakes.

2 Claims, 6 Drawing Figures

APPARATUS FOR TIME SHARING OF HORIZONTAL AND VERTICAL ADVANCE

BACKGROUND OF THE INVENTION

A prime mover or power drive device has been used extensively in the past to provide incremental or intermittent motion to more than one operating member, the purpose being to share a common driver both apparatus-wise and time-wise. In the case of an electric motor, either A C or D C, the motor may be of the continuous run type and engaging and disengaging means, in the nature of a combination of clutches and brakes, are positioned in the drive train to provide the desired motion. In this respect, the clutch or clutches engage the rotating drive to direct the motion to the operating apparatus or members, and then the clutch or clutches are made to be disengaged from the rotating drive, with the brake or brakes being utilized to rapidly decelerate and to stop driving motion to the operating members. In this approach, the clutch always is engaged with and disengaged from a dynamic or moving drive line, with the brake being likewise used in a dynamic manner. In other instances, a prime mover of the stepping type may also be used to provide incremental motion to the operating members.

While the closed loop control mode having a switching amplifier and a feedback circuit with pulse width modulated signals is representative and common in the art, certain improvements are being sought in the overall system to provide faster and more efficient equipment.

Representative of prior art in the area of the present invention is U.S. Pat. No. 2,929,268 to J. A. Ferro et al. which discloses a bi-directional incremental drive mechanism for use in servo systems and which includes drive and driven shafts with friction clutches and pawl and cam arrangements in the drive train. A continuously running motor is connected to the driving shafts which are rotatable in opposite directions and the friction clutches connect the driving and driven shafts. The pawl and cam arrangements enable advanced and retracted positions, the driven shafts being free to rotate in the pawl retracted position, and the pawls being normally biased in the advanced positions and responsive to servo signals for actuation to temporary retracted positions.

Another example of prior art is U.S. Pat. No. 3,667,383 to R. H. Mack et al. which discloses a print and transport belt synchronizer for a printer having a continuously rotating print drum and a control system including a pair of timing discs, one disc indicating the angular position of the drum and the second disc operating to signal the hammer carrier to engage the transport belt, there being a double-ended transducer responsive to the timing discs to provide appropriate signals for the printer.

SUMMARY OF THE INVENTION

The present invention relates to drive and control mechanism for incremental or intermittent motion and more particularly to method and apparatus for sharing the output of a prime mover for providing motion in two directions under static operating conditions.

The general area of application for the present invention is in a printer having a horizontal font family of printing devices wherein a bank of hammers is caused to be moved a limited distance in a horizontal direction and the associated paper or printing media is caused to be driven in a vertical direction in an arrangement for sharing the driving motion from a single prime mover. The prime mover in the instant application may be a D C servo motor connected in a closed loop velocity control circuit with position feedback wherein a start command produces a reference signal which is compared with a voltage read from a tachometer connected to the motor, and enabling a resulting D C error signal to be produced in the circuit. The error signal is routed through a pulse width converter and is compared with the motor current, there then being a pulse width modulated control signal to activate the accelerate side of an H switch to rapidly accelerate the motor, with clutch engagement prior to start and acceleration of the motor, to the desired speed for incremental or intermittent amounts of time, after which a stop signal from position transducers indicates the beginning of deceleration of the motor and the reference signal is then changed to feed the pulse width modulated decelerate current to the decelerate side of the H switch, with clutch disengagement being made at a time after the deceleration portion of the cycle and after the motor has stopped.

The subject matter of the present invention is directed to method and apparatus for accomplishing incremental or intermittent motion of at least two operating members or devices of a printer through time sharing of the output of a servo motor which is controlled in a closed loop manner by use of circuitry and related devices for acceleration, running and deceleration of the motor and thereby the operating members in a static, as distinguished from a dynamic, mode. The invention comprises such closed loop circuit controlled prime mover and means connected with the prime mover and with the operating members for permitting acceleration and deceleration of such operating members in a manner where such members are incrementally or intermittently moved in the drive line from the motion of the prime mover. Specifically, the acceleration and deceleration mechanism includes the use of a planetary gear head assembly and associated electromagnetic friction brakes, one portion of the gear head assembly being utilized for the hammer bank of the printer and the other for the printing media or paper, the friction brakes being energized, with the motor at rest, to be connected thereto, and driving the gear head assemblies at predetermined times, and the brakes being deenergized in a time sharing manner all in cycles of operation to move the hammer bank in a horizontal direction and to move the paper in a vertical motion in such incremental or intermittent mode.

A modification in the drive line includes, in place of the friction brakes, a planetary gear head assembly and band type brakes for operation in the acceleration and deceleration of the operating members.

A further modification in the drive line includes a pair of clutches for control of the operating members.

In view of the above discussion, the principal object of the present invention is to provide incremental or intermittent motion in a time shared manner to operating members of a printing apparatus.

Another object of the present invention is to provide a drive train having devices therein for advancing a plurality of operating members under static conditions.

An additional object of the present invention is to provide method and apparatus for producing incremental motion of operating members in a time shared multi-directional advance of the members.

A further object of the present invention is to provide method and apparatus for producing incremental motion of operating members in a time shared horizontal and vertical advance thereof from a single prime mover.

Still another object of the present invention is to provide a drive line and devices therein connected with a prime mover for advancing operating members in incremental or intermittent manner under static conditions.

Still an additional object of the present invention is to provide apparatus for producing incremental motion to operating members in an X-Y direction of movement or a variation thereof.

And, a further object of the present invention is to provide a drive line connected with a prime mover, there being clutch and/or brake devices in the drive line and controlled in a mode to produce incremental motion to operating members in a time shared manner under static conditions.

Additional advantages and features of the present invention will become apparent and fully understood from a reading of the following description taken together with the annexed drawing, in which.

Figure 1:
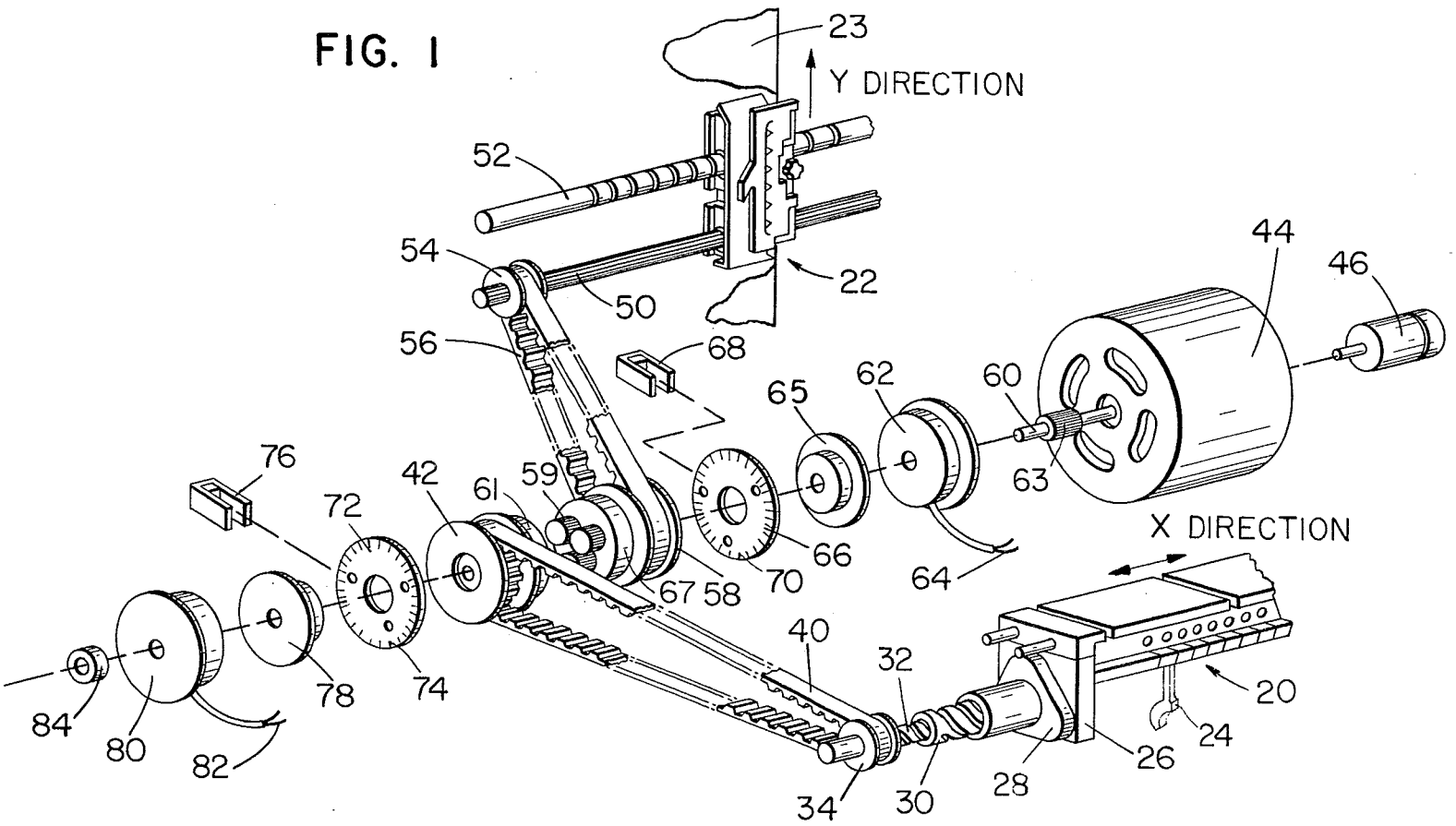
FIG. 1 is an exploded view of the various parts and showing one form of apparatus in the drive line for producing motion to the operating members.

As illustrated in FIG. 1 of the drawing, which is a fragmentary and exploded view of a printer incorporating a print station, a hammer bank mechanism 20 and a tractor mechanism 22 are the important elements of the printer wherein the paper 23 or like media is driven past the hammers 24 which are supported by a carriage 26 associated with a support portion 28 of a screw drive on the left-hand side of the carriage 26. The carriage 26 is made to travel a limited distance in a side-to-side or X direction, as shown by the arrow above the mechanism 20, in response to a program for printing, by means of an anti-backlash lead screw 30 which cooperates with a threaded shaft 32 carrying a pulley 34. While a lead screw arrangement is entirely satisfactory for driving or transporting the hammer bank in the direction transverse to movement of the paper 23, a cam and pawl structure could also be utilized to incrementally or intermittently move the carriage to the desired printing positions.

A preferred form of the invention includes structure to cause transverse movement of the hammer bank 20 to accommodate the space or width of two characters, however, such structure is designed to incrementally drive the bank 20 up to six positions or spaces in the side-to-side direction. The transverse movement of the hammer bank 20 is generally predetermined for a line of printing wherein, with a width of 132 print spaces available on a belt or chain, a hammer bank of 66 hammers would be moved one space bi-directionally to cover the width of two characters with each hammer, a bank of 44 hammers would be moved two spaces to cover three characters, and a bank of 22 hammers could be utilized to print up to six spaces bi-directionally to complete a line of printing.

Each of the hammers 24 is associated with a striker assembly (not shown) comprising an electromagnet, actuated upon demand, and a pushrod assembly wherein the pushrod element is advanced to impact against the hammer 24 and drive the hammer against one of a plurality of print or type characters carried on the belt or chain. This type of print hammer and actuating mechanism is well-known in the art of horizontal-band type line printers.

A toothed belt 40 connects the pulley 34 and a hammer bank pulley and planetary gear assembly 42 in driving relationship, the assembly 42 being in the drive line of a prime mover 44, which in the instant application is a D C servo motor which is especially applicable for the intended use and operation. A tachometer 46 is directly connected with the motor 44 for deriving an indication of the precise speed of the motor at all times, and for an additional purpose to be described.

The tractor mechanism 22 (it being understood that a like mechanism is positioned to cooperate with the one shown) is carried on a pair of parallel members, the lower member being in the form of a drive shaft 50 for driving the tractor mechanism 22 to move the paper 23 generally in an upwardly direction, as shown by the arrow, past the printing station. Details of the tractor mechanism form no part of the present invention, but suffice it to say that a pair of pulleys carry a toothed belt for engaging with and driving the paper in the desired direction in incremental operation, the lower pulley being a driving pulley cooperating with the shaft 50 and the upper pulley being in the nature of an idler carried on a smooth-surfaced guide shaft or rod 52, although the rod 52 is shown with annular grooves which may be for the purpose of locking the tractor mechanism in a desired transverse direction to accommodate different widths of paper. The shaft 50 carries a pulley 54 at one end thereof and a toothed belt 56 connects the pulley 54 with a paper motion pulley and planetary gear assembly 58 cooperating with the adjacent assembly 42 for sharing motion from the motor 44.

In the drive line from the motor 44 which has a shaft 60 of sufficient length to carry the required parts, an electromagnetic brake 62 is positioned adjacent the motor, the brake having lead wires 64 for connection to appropriate data processing control means responsive to programming in the operation of paper motion in relation to the printing cycle. A disk member 65 is next in the line up and presents a braking surface cooperating with the brake 62, there being a paper motion code disk 66 adjacent member 65 with a board sensing member 68 for effectively sensing the position of the disk 66, the disk having a plurality of sensing holes or slots 70 therein for position feedback.

The planetary gear head 58 includes the pulley for the belt 56 and a plurality of planetary gears 59 operating with a ring gear 61 to provide the desired effect in relation to the hammer bank assembly 42 which likewise has the pulley for the belt 40 and the ring gear for operating with the planetary gears of assembly 58. Adjacent the assembly 42 is a hammer bank code disk 72 having a plurality of sensing holes or slots 74 therein and cooperating with a board sensing member 76 for position feedback. A disk 78 has a braking surface thereon which cooperates with an electromagnetic brake 80, the brake having lead wires 82 for connection to control means responsive to the operation of the hammer bank in relation to paper motion. A bearing 84 is suitably placed in the drive line for carrying the end of the driving shaft 60.

The planetary gear assembly is that of a simple epicyclic arrangement of planetary gear and star gear construction wherein a sun gear 63 is secured to the motor shaft 60 to rotate therewith, the sun gear 63 meshing with the planet gears 59, which gears are carried by individual spindles for rotation thereon, and the planet gears 59 meshing with the ring gear 61, there being a planet carrier 67 for the gears 59. The gearhead system is utilized to drive the tractor mechanism 22, by means of the belt 56 and the shaft 50, whereupon when the ring gear 61 is held fixed by the electromagnetic brake 80, the planet carrier 67 is operating as the output member of the planetary gear assembly to incrementally drive the tractors 22 for advancing the paper 23. When the planet carrier 67 is held fixed by the electromagnetic brake 62, the ring gear 61 is the output member and incrementally drives the hammer bank 20, through the belt 40 and the lead screw 30-shaft 32 arrangement, the desired number of spaces in such side-to-side direction. In the case of the tractor drive 22, the planet carrier 67 is the rotating part, whereas in the case of the hammer bank drive, the ring gear 61 is the rotating part of the gear assembly, the control of the several parts, as to engagement and disengagement for motion or no-motion of the output members of the planetary gear assembly, being accomplished by operation of the electromagnetic brakes 62 and 80 from the printer control system.

At the time of the engagement and disengagement of the driving members which comprise the planetary gear assembly, the prime mover or motor 44 is in a stopped or static condition, whereby when it is desired to move the paper 23 upwardly or in the Y direction, e.g. by one line space, the ring gear 61 is held fixed by the brake 80 and the motor 44 is accelerated to run and thereby drive the planet carrier 67 and the tractor 22, whereupon the motor is decelerated and stopped. When it is desired to print a line on the paper 23, the hammer bank 20 is caused to be moved either right or left to the required position, the motor 44 being at rest upon engagement and disengagement of the various parts, the planet carrier 67 is held fixed by the brake 62 and the motor 44 is then accelerated to run and thereby drive the ring gear 61 to transversely drive the hammer bank 20 the desired number of spaces in the X direction. In this respect, the engagement and disengagement of the brakes 62 and 80 with the respective driving output member of the gear assembly is always accomplished when the motor 44 is at rest, or in the static, as distinguished from the dynamic, condition.

Further to the above, while FIG. 1 shows the exploded view of the various parts in the drive line, it is, of course, understood that the shaft 60 of motor 44 extends through such parts to the bearing or end piece 84, and that the sun gear 63 is secured on the motor shaft 60 to rotate therewith, the planetary gears 59 being positioned to surround and be continually engaged with the sun gear 63, such gears 59 being journaled on respective spindles to be freely rotatable thereon. Likewise, the ring gear 61 surrounds the planet gears 59 and the teeth of the ring gear 61 are continually engaged with the teeth of the planetary gears 59 in well-known construction to enable selective rotational output of either the planetary gear carrier 67 or the ring gear member 61 upon holding of the respective part from rotation.

In clarifying discussion of the operation of the planetary gearset, when the tractor mechanism 22 is to be driven to advance the paper 23, the brake 80 is energized (with the motor 44 at rest) to lock the gear assembly 42 and the ring gear 61 integral therewith from rotation, the brake 62 being in the deenergized condition so as not to interfere with rotation of the gear assembly 58. The motor 44 is then spiked to rotate the sun gear 63 which is engaged with the planet gears 59 for driving rotation thereof, and since the ring gear 61 is held from rotation, the planet gears 59 must be rotated on their spindles by the sun gear 63 and therefore travel around the interior portion of the ring gear 61 in a revolving manner in relation to the sun gear 63, the revolving movement, of course, causing rotation of the entire gear assembly 58 for driving the belt 56 and the shaft 50.

In similar manner, when the hammer bank 20 is to be displaced in a horizontal direction, the brake 62 is energized (with the motor 44 at rest) to lock the gear assembly 58 and the planetary gear carrier 67 integral therewith from rotation, the brake 80 being in the deenergized condition so as not to interfere with rotation of the gear assembly 42. The motor 44 is then spiked to rotate the sun gear 63 which is engaged with the planet gears 59 for rotation thereof, and since the planet carrier 67 is held from rotation, the planet gears 59 are caused to be rotated on their spindles by the rotating sun gear 63, however, the rotation of the planet gears 59 is "in place" as distinguished from the revolving motion thereof, as mentioned above. The rotation of the planet gears 59 by the sun gear 63 then causes driving rotation of the ring gear 61 and of the entire gear assembly 42 for driving the belt 40 and the lead screw 30 and shaft 32 for the bank 20.

Figure 2:
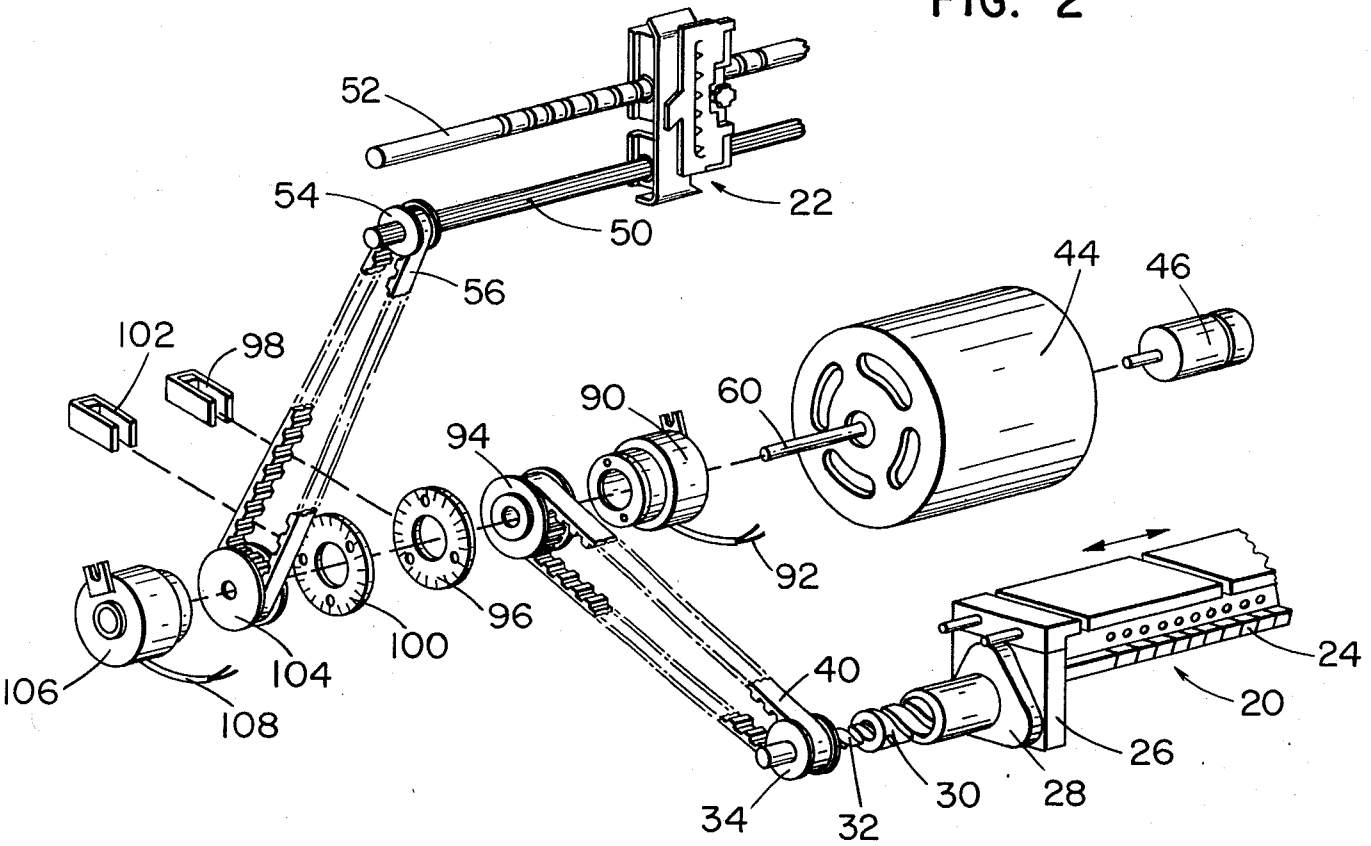
FIG. 2 is a similar view as FIG. 1 of the various parts and showing a different form of apparatus in the drive line.

In FIG. 2 is shown a modification in the drive line to include, in lieu of the electromagnetic brakes, a pair of clutches to provide means of time sharing the output motion from the motor 44. The hammer bank 20 and carriage 26 arrangement is substantially identical with that previously described as is the tractor mechanism 22 and supporting structure for paper movement. Although the belt 40 for driving the pulley 34 is shown nearer the motor 44 and the belt 56 for driving the pulley 54 is further from such motor, i.e., in an arrangement different from that shown in FIG. 1, a reversal of these parts in the drive line may be a matter of choice and does not affect the nature of the invention. An electromagnetic clutch 90 is positioned adjacent the motor 44 and has lead wires 92 connected to control means responsive for operation of the hammer bank. The belt 40 is connected between the pulley 34 and a pulley 94 in the drive line for driving the hammer bank in a time shared manner. A hammer bank code disk 96 cooperating with a sensing board 98 and a paper motion code disk 100 cooperating with a sensing board 102 are positioned between the hammer bank pulley 94 and a paper motion pulley 104, there being an electromagnetic clutch 106 lastly in the drive line with lead wires 108 connected to appropriate control means. Actuation of the clutch 90 causes the pulley 94 to be rotated by the shaft 60 of motor 44 to thereby displace the hammer bank 20 the required number of spaces, and in like manner, the clutch 106 is actuated to cause the pulley 104 to be rotated by the shaft 60 to rotate the shaft 50 and thereby drive the tractor 22 in a time sharing machine.

Figure 3:
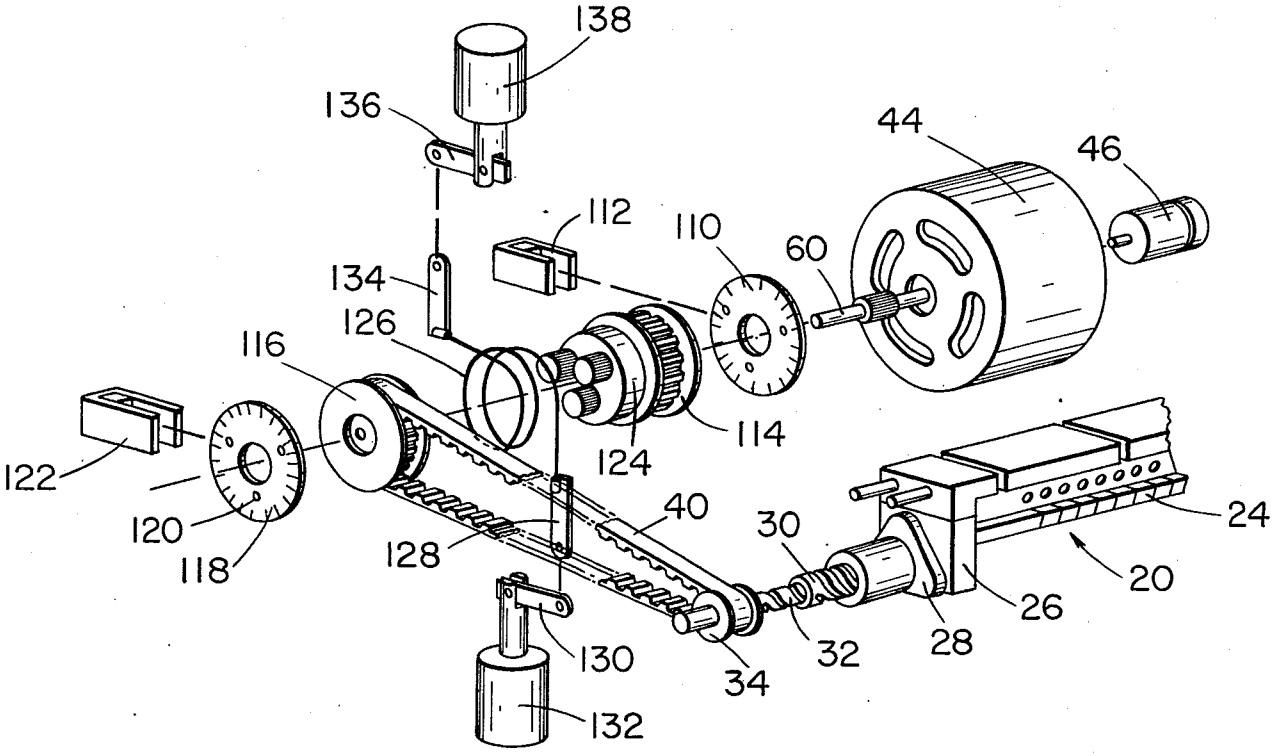
FIG. 3 is a similar view as FIGS. 1 and 2 of the various parts and showing a further form of apparatus.

A further modification is shown in FIG. 3 wherein planetary gear head assemblies are positioned in the drive line and band-type brakes are utilized rather than the friction brakes shown in FIG. 1. Again the hammer bank 20 and carriage 26 arrangement is substantially identical with that previously described, as is the tractor mechanism and supporting structure (although not shown) for the paper movement. A paper motion code disk 110 cooperating with a sensing board 112 is in the drive line between the motor 44 and a paper motion pulley and planetary gear carriage assembly 114 for driving in time shared manner the tractor mechanism. A hammer bank pulley and planetary gear assembly 116 is adjacent the assembly 114 for cooperating therewith and a hammer code disk 118 with a plurality of holes 120 therein cooperates with a sensing board 122. The planetary gear assembly includes a peripheral surface, on a planetary carrier such as shown at 124 on assembly 114, for receiving a band-type brake 126 in the form of a plurality of coils operating on the peripheral surface 124 and connected at one end to an attaching member 128, in turn connected to a lever 130 for a solenoid 132. The other end of the coil 126 is likewise connected to an attaching member 134, in turn connected to a lever 136 for a solenoid 138. The band brakes in the form of such plurality of coils operate with the planetary gear head to time share the motion from the motor 44 by clutching either the planetary carrier 124 or the ring gear 125 for the desired motion. In the arrangement, a bi-directional band brake is used to provide bi-directional motion at the hammer bank by braking the carrier 124 in both directions, while a single band is used to brake the ring gear, 125 thus allowing one directional paper motion. As in the FIG. 1 construction, when the planetary carrier 124 is braked or held fixed from rotation by the band brake 126 upon actuation of solenoid 132, the ring gear 125 is the output member and drives the hammer bank 20 in the desired side-to-side direction. When the ring gear 125 is braked or held fixed from rotation by the band brake 126 upon actuation of solenoid 138, the planetary carrier 124 performs as the output member to drive the tractor 22 for incremental motion of the paper 23. Again, the engagement and disengagement of the several parts is accomplished in the rest condition of the motor 44.

Figure 4:
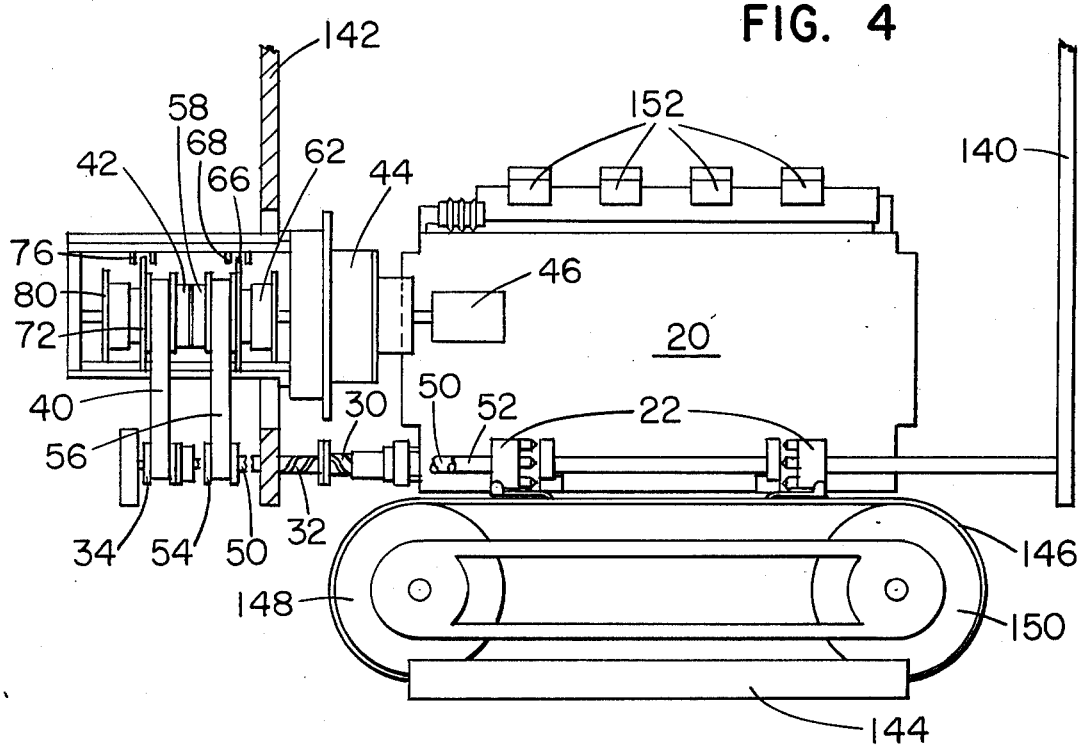
FIG. 4 is a diagrammatic illustration of a type of printer incorporating the features of the present invention.

In FIG. 4 is shown a partial view in diagrammatic form of a printer incorporating the subject matter of the present invention, the showing being a top or plan view with side frame members 140 and 142 supporting the various parts such as the hammer bank 20, the tractor mechanisms 22, the motor 44 and the associated drive line connected at the left hand side thereof. Also shown in a horizontal arrangement of printing mechanism including type array 144, a belt or chain 146 carried on pulleys 148 and 150, and driven by appropriate means which may be like the motor 44. The paper 23, although not shown, is driven by the tractors 22 past the print station and between the belt 146 and the hammer bank 20. Although such plan view shows the drive belts 40 and 56 to appear at a certain plane, the drive belt 56 is necessarily directed forwardly and upwardly from the drive line to connect with the shaft 52 for the tractors 22, and thereby the paper 23 in a generally vertical direction, the drive belt 40 being directed generally forwardly from the drive line to connect with the shaft 32 for driving of the hammer bank 20 in a side-to-side or horizontal direction. Such horizontal movement is for the purpose of positioning each of the hammers 24 (although not shown) of the hammer bank 20 in at least two positions so that in a typical 132 column width paper, only 66 hammers are required to effect printing, there being the appropriate number of electrical connectors 152 for connecting to the required circuitry.

Figure 5:
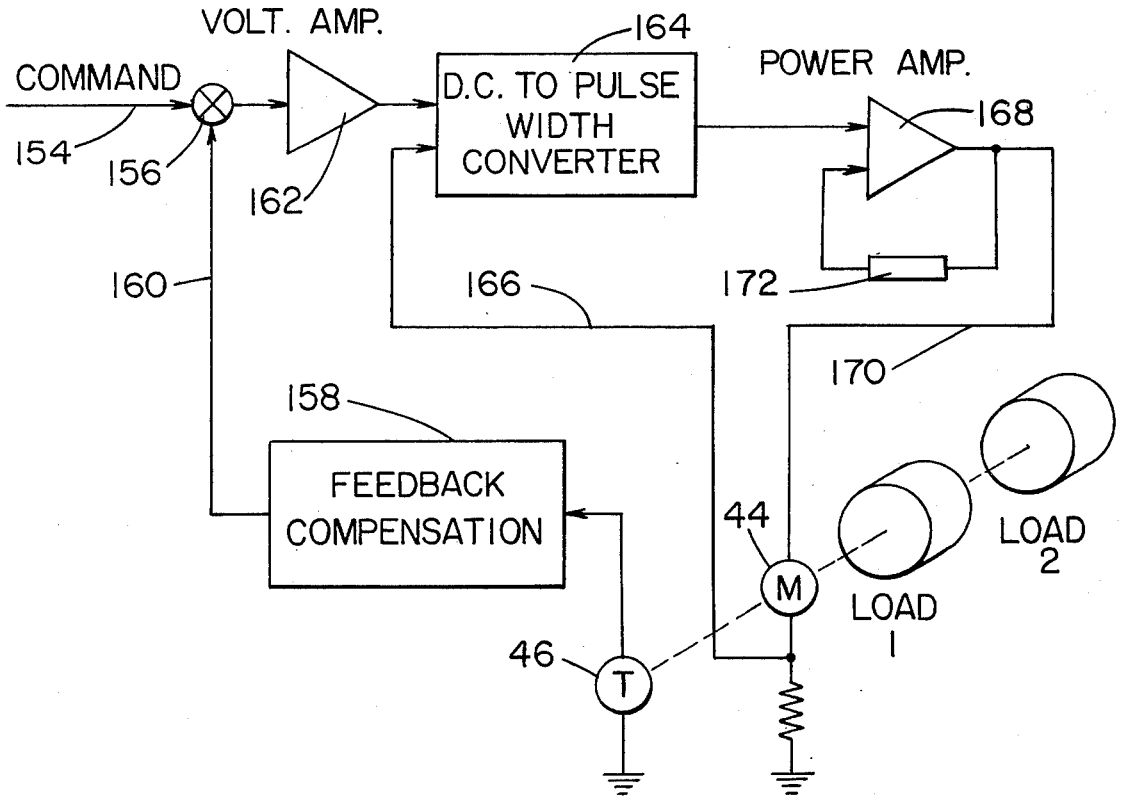
FIG. 5 is a block diagram of a closed loop circuit useful in carrying out the provisions of the present invention.

As alluded to earlier in the description, the closed loop control circuit used in the invention is shown generally in FIG. 5 for the two loads, designated as Load 1 and Load 2, the paper motion drive and the hammer bank motion drive, respectively. The invention utilizes a conventional velocity servo circuit with position feedback wherein a start command 154 produces a reference signal which is entered into a comparator 156 and compared with a voltage generated from the tachometer 46 through a feedback compensator 158 and through a line 160 to the comparator. Since the tachometer 46 is directly connected to the motor 44, there is a continuous monitoring of the motor speed from rest to run and back to rest. The resulting D C error signal is sent through a voltage amplifier 162 and then through a D C to pulse width converter 164 where it is compared with the motor current flowing through a line 166. The pulse width modulated control signal is sent through a power amplifier 168 and to the accelerate side of an H switch (not shown) and then through line 170 to the motor 44.

The control system is substantially a hybrid system wherein the incremental or intermittent motion is accomplished through alternate use of velocity and position control modes, the motion being performed under velocity control according to a desired velocity profile and stopping of the motor is done through the position control mode. The stop signal is effected from position transducers (not shown) to indicate the start of deceleration and thus change the reference signal to a decelerating ramp and the pulse width modulated decelerate current is fed to the decelerate side of the H switch to stop the motor 44. An advantage of the pulse width modulation system is that of maintaining a constant switching frequency which is especially valuable in control and operation of increasing and decreasing loads, and may be in the nature of a frequency regulator 172. Although other control modes may be applicable for the system, the one shown is typical for a general understanding of the closed loop mode as utilized with the present invention. In the case of such hybrid control system, the desired incremental motion or acceleration and run portion of the cycle is performed under velocity control in accordance with a desired velocity profile, whereas deceleration and stopping is performed by the position control mode for greater accuracy through use of a mode selection device. A typical system may include a mode selector switch wherein with the switch open, the position feedback is disconnected and the system operates as a velocity control, whereas with the switch closed, the circuitry is added for position control. In this manner, the respective output member and the shaft 60 of the motor 44 are locked in the desired position after stopping and the engagement and disengagement of the driving member is always performed when the motor is at rest.

Figure 6:
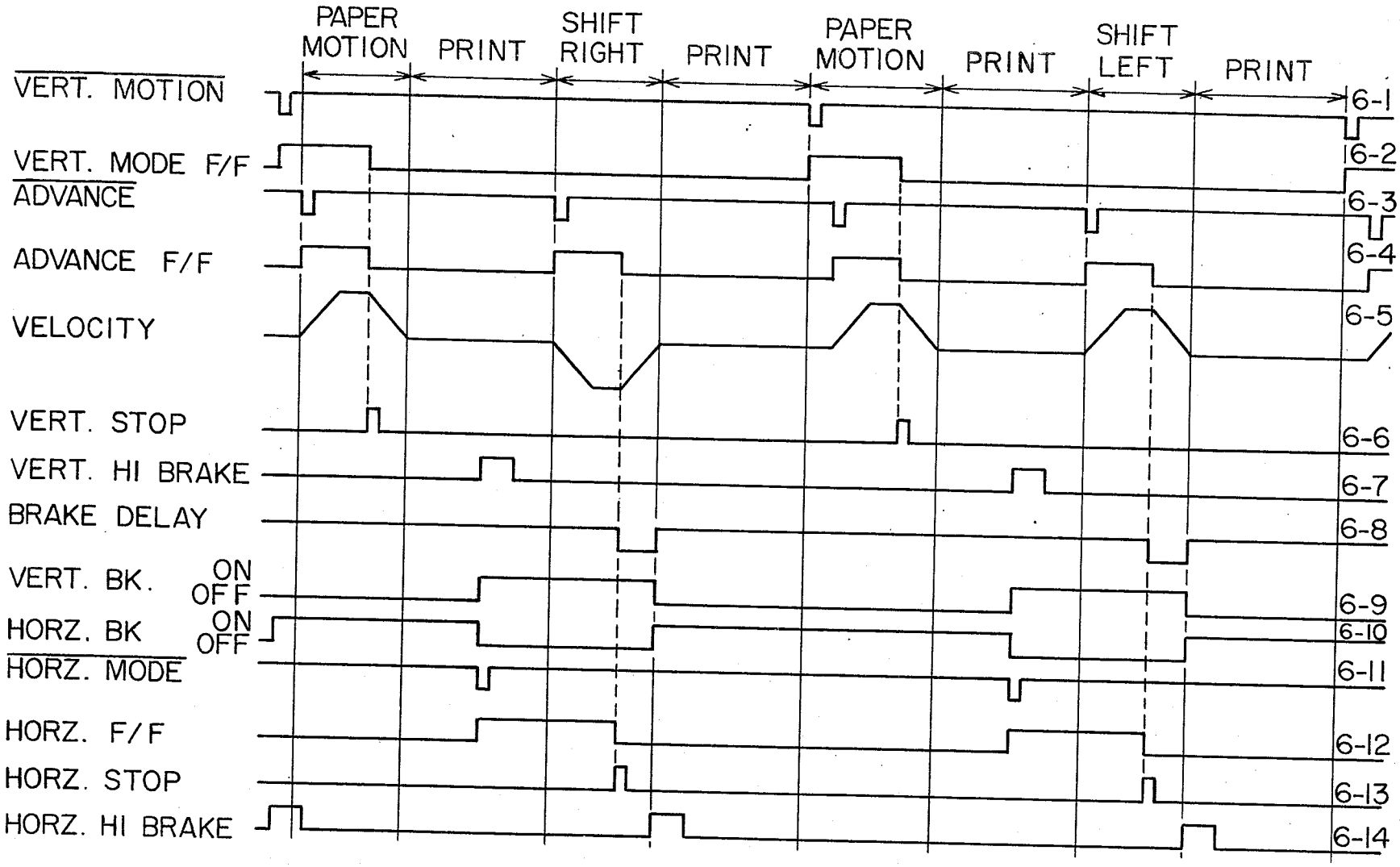
FIG. 6 is a timing diagram illustrating the operation of the mechanism under the preferred static conditions.

FIG. 6 shows the timing drawing of the various timing cycles of operation used in the circuitry of the time sharing of horizontal and vertical advance of the operating members in the present invention. The cycle of timing is repeated for the two directions of horizontal advance as seen by the captions at the top of the diagram where the time is divided into paper motion, print, shift right, and print, the cycle then being repeated where the time is divided into paper motion, print, shift left, and print. The paper 23 is thusly made to move vertically during time of non-print, printing is performed, the hammer bank 20 is caused to shift right or horizontally advance, and printing is again performed. The same cycle is then repeated for the shift left or horizontal advance after the paper 23 is made to be vertically advanced.

With power turned on, the controller sends a vertical mode pulse, line 6-1, as a command signal, such pulse sets the vertical mode flip-flop, line 6-2, and turns on the horizontal low brake, line 6-10 and the horizontal high brake, line 6-14. The horizontal high brake turns off after a short time. Shortly after the vertical mode pulse is made, the controller sends an advance pulse, line 6-3, which initiates the ramp generator to start and accelerate the motor 44, as seen by the velocity profile, line 6-5, and also sets the advance flip-flop, line 6-4. The motor is accelerated to a running or constant velocity attitude as shown by such velocity profile. A vertical stop pulse, line 6-6, is sent from the code disk mounted on the motor 44, the vertical stop resets the vertical mode flip-flop, line 6-2, it resets the advance flip-flop, line 6-4, and starts the ramp slope or velocity profile, line 6-5, to 0, to stop the motor.

The printing now takes place and during the print cycle, the controller sends a horizontal mode pulse, line 6-11, which turns the horizontal brake, line 6-10, low current off, and turns on both the vertical low brake, line 6-9, and the vertical high brake, line 6-7, along with setting the horizontal flip-flop, line 6-12. The vertical high brake is turned off a short time later.

At the end of printing, the controller sends an advance pulse, line 6-3, which starts the ramp generator and sets the advance flip-flop, line 6-4, which starts the motor to shift the hammer bank 20 to the right. Next in time is the horizontal stop pulse, line 6-13, which is sent from the code disk mounted on the motor, and which horizontal stop pulse initiates the vertical and horizontal brake delay, line 6-8, starts the ramp generator slope to 0 to stop the motor, and resets the advance flip-flop, line 6-4. The vertical and horizontal brake delay waits for the motor to stop. At the end of the vertical and horizontal brake delay, the vertical low brake, line 6-9, current is turned off, the horizontal low brake, line 6-10, current is turned on, and the horizontal high brake, line 6-14, current is turned on, but is turned off a short time later. The print cycle is then repeated.

At the end of the print cycle, the controller sends a vertical mode pulse, line 6-1, which sets the vertical mode flip-flop, line 6-2. Shortly thereafter, the controller sends an advance pulse, line 6-3, which sets the advance flip-flop, line 6-4, and starts the ramp generator, line 6-5, which starts the motor to advance the paper 23. The vertical stop pulse, line 6-6, is sent from the code disk mounted on the motor and which starts the ramp generator slop to 0 to stop the motor, and resetting both the vertical mode flip-flop, line 6-2, and the advance flip-flop, line 6-4, after which time printing takes place. The horizontal movement of the hammer bank 20 is then effected in the same manner as before except that the bank is shifted left.

In the operation of the time shared concept, the motor is closed-loop controlled by utilizing a velocity servo with position feedback wherein a start command produces a reference signal which is compared with the tachometer voltage, thus resulting in a D C error signal. The error signal is fed through a D C to pulse width converter and is compared with the motor current and a pulse width modulated control signal is applied to the accelerate side of an "H" switch and a ramp pattern of motor current is seen at the constant speed portion of the cycle, in acceleration, run, and deceleration of the motor. A stop signal from position transducers indicates the start of deceleration from the constant speed and the reference signal and pattern is a decelerating ramp pattern wherein the pulse width modulated current is fed to the decelerate side of the H switch.

The above-described apparatus provides for different methods of time sharing the rotational motion of the motor 44 and transducing the precise servo motor output to the two loads. The operation is static in principle and concept to provide for longer clutch and brake life.

It is thus seen that herein shown and described is a method and apparatus for time sharing the rotational motion of a prime mover to advance the two loads, the hammer bank in a horizontal direction and the paper motion in a vertical direction. Such apparatus enables the accomplishments of the objects and advantages mentioned above, and while several embodiments of the invention have been disclosed herein, certain other variations may occur to those skilled in the art. As briefly mentioned above, the apparatus provides dual direction drive means in a time shared manner, wherein the motion may be incremental or it may be intermittent in X-Y, X-X, or Y-Y direction of operation, that is, the dual direction drive concept may be utilized to provide motion in a horizontal-vertical direction as disclosed, in a horizontal-horizontal direction, or in a vertical-vertical direction in such time shared manner. Such variations may also include the features of running and operating the two clutches at the same time, the planetary gear heads can be applicable for either one direction of drive or the other direction, and the position transducers can be a part of the driven members. Additionally, a stepping action can be utilized for paper motion as well as for hammer bank travel. Thus, it is contemplated that all such variations, not departing from the spirit and scope of the invention hereof, are to be construed in accordance with the following claims.

What is claimed is:

1. In a printer having a print station including printing mechanism and a hammer bank operably associated therewith and movable to a plurality of print positions along the line of printing, and means for advancing paper past the print station, a prime mover caused to be driven in intermittent manner, first drive means connected with said paper advancing means, second drive means connected with said hammer bank for displacing thereof in a direction transverse of the direction of paper travel, means operably associated with said prime mover and with said first and said second drive means for causing alternate operation of said first and said second drive means, and means connected with said operably associated means for controlling the alternate operation of said first and said second drive means in intermittent manner, said means operably associated with said prime mover and with said first and said second drive means including engageable and disengageable members being connected and disconnected in the rest condition of said prime mover and operable for sequentially advancing said paper and displacing said hammer bank upon energization of said prime mover.

2. In the printer of claim 1 wherein said means operably associated with said prime mover and with said first and said second drive means includes a planetary gear assembly having a pair of output members one output member being associated with said first drive means and the other output member being associated with said second drive means, and said controlling means includes a pair of electromagnetic friction brake elements alternately connected with said output members whereby energization of one brake element holds said first drive means from rotation while enabling rotation of said second drive means and energization of the other brake element holds said second drive means from rotation while enabling rotation of said first drive means for moving said paper and said hammer bank in operational directions normal to one another.

* * * * *